US010544695B2

(12) United States Patent
Chouhan et al.

(10) Patent No.: US 10,544,695 B2
(45) Date of Patent: Jan. 28, 2020

(54) TURBINE BUCKET FOR CONTROL OF WHEELSPACE PURGE AIR

(71) Applicant: General Electric Company, Schenectady, NY (US)

(72) Inventors: Rohit Chouhan, Bangalore (IN); Soumyik Kumar Bhaumik, Bangalore (IN)

(73) Assignee: General Electric Company, Schenectady, NY (US)

( * ) Notice: Subject to any disclaimer, the term of this patent is extended or adjusted under 35 U.S.C. 154(b) by 132 days.

(21) Appl. No.: 14/603,314

(22) Filed: Jan. 22, 2015

(65) Prior Publication Data

US 2016/0215636 A1 Jul. 28, 2016

(51) Int. Cl.
*F01D 11/00* (2006.01)

(52) U.S. Cl.
CPC ..... *F01D 11/001* (2013.01)

(58) Field of Classification Search
CPC ..... F01D 11/001; F01D 11/02; F01D 11/08
See application file for complete search history.

(56) References Cited

U.S. PATENT DOCUMENTS

| | | | | |
|---|---|---|---|---|
| 5,211,533 | A | 5/1993 | Walker et al. | |
| 5,417,545 | A | 5/1995 | Harrogate | |
| 5,893,984 | A | 4/1999 | Thompson | |
| 6,077,035 | A | 7/2000 | Walters et al. | |
| 6,276,692 | B1 * | 8/2001 | Beeck | F01D 11/04 277/411 |
| 6,783,323 | B2 | 8/2004 | Shiozaki et al. | |
| 7,044,710 | B2 | 5/2006 | Naik et al. | |
| 7,114,339 | B2 | 10/2006 | Alvanos et al. | |
| 7,189,055 | B2 | 3/2007 | Marini et al. | |
| 7,189,056 | B2 | 3/2007 | Girgis et al. | |

(Continued)

FOREIGN PATENT DOCUMENTS

| | | |
|---|---|---|
| EP | 2581555 A1 | 4/2013 |
| EP | 2586995 A2 | 5/2013 |

(Continued)

OTHER PUBLICATIONS

European Search Report and Opinion in relation to U.S. Appl. No. 14/603,316 dated Jun. 28, 2016, 7 pages.

(Continued)

*Primary Examiner* — Carlos A Rivera
*Assistant Examiner* — Cameron A Corday
(74) *Attorney, Agent, or Firm* — Dale Davis; Hoffman Warnick LLC

(57) ABSTRACT

Embodiments of the invention relate generally to rotary machines and, more particularly, to the control of wheel space purge flow in gas turbines. In one embodiment, the invention provides a turbine bucket comprising: a platform portion; an airfoil extending radially outward from the platform portion; a shank portion extending radially inward from the platform portion; at least one angel wing extending axially from a face of the shank portion; a platform lip extending axially from the platform portion, the platform lip disposed radially outward from the at least one angel wing; and a plurality of turbulators disposed along and extending outward from the face of the shank portion between the platform lip and the at least one angel wing.

20 Claims, 11 Drawing Sheets

(56) References Cited

U.S. PATENT DOCUMENTS

| | | | | |
|---|---|---|---|---|
| 7,244,104 | B2 | 7/2007 | Girgis et al. | |
| 7,665,964 | B2 | 2/2010 | Taylor et al. | |
| 8,057,178 | B2 | 11/2011 | Itzel et al. | |
| 8,083,475 | B2 * | 12/2011 | Bulgrin | F01D 11/001 415/173.7 |
| 8,186,952 | B2 | 5/2012 | Tibbott | |
| 8,419,356 | B2 | 4/2013 | Little | |
| 8,834,122 | B2 | 9/2014 | Ingram | |
| 8,939,711 | B2 | 1/2015 | Lee et al. | |
| 8,979,481 | B2 | 3/2015 | Ingram | |
| 9,017,014 | B2 * | 4/2015 | Lee | F01D 5/082 415/115 |
| 9,039,357 | B2 | 5/2015 | Lee | |
| 9,121,298 | B2 * | 9/2015 | Lee | F01D 11/001 |
| 2006/0269399 | A1 | 11/2006 | Girgis et al. | |
| 2012/0163955 | A1 | 6/2012 | Devi et al. | |
| 2012/0251291 | A1 | 10/2012 | Ledezma et al. | |
| 2013/0108441 | A1 | 5/2013 | Ingram | |
| 2013/0108451 | A1 | 5/2013 | Ingram | |
| 2013/0170983 | A1 | 7/2013 | Babu et al. | |
| 2013/0302141 | A1 | 11/2013 | Quach et al. | |
| 2014/0003919 | A1 | 1/2014 | Lee et al. | |
| 2014/0147250 | A1 | 5/2014 | Lee et al. | |
| 2014/0205443 | A1 | 7/2014 | Lee et al. | |
| 2014/0234076 | A1 | 8/2014 | Lee et al. | |
| 2014/0271111 | A1 | 9/2014 | Ballard, Jr. et al. | |
| 2014/0286760 | A1 | 9/2014 | Lee | |

FOREIGN PATENT DOCUMENTS

| | | | |
|---|---|---|---|
| EP | 2586996 | A2 | 5/2013 |
| GB | 2251040 | A | 6/1992 |
| JP | 2004100578 | A | 4/2004 |
| WO | 2011029420 | A1 | 3/2011 |

OTHER PUBLICATIONS

European Search Report and Opinion in relation to U.S. Appl. No. 14/603,321 dated Jun. 28, 2016, 5 pages.
European Search Report and Opinion in related to U.S. Appl. No. 14/635,352, dated Jul. 12, 2016, 8 pages.
U.S. Appl. No. 14/635,352, Office Action 1 dated Mar. 9, 2017, 42 pages.
U.S. Appl. No. 14/603,321, Office Action 1 dated Apr. 13, 2017, 30 pages.
U.S. Appl. No. 14/603,316, Office Action 1 dated May 31, 2017, 39 pages.
U.S. Appl. No. 14/603,316, Final Office Action 1 dated Sep. 15, 2017, 24 pages.
U.S. Appl. No. 14/603,321, Final Office Action 1 dated Sep. 22, 2017, 27 pages.
U.S. Appl. No. 14/603,318, Final Office Action 1 dated Nov. 27, 2017, 15 pages.
U.S. Appl. No. 14/635,352, Final Office Action 1 dated Dec. 6, 2017, 13 pages.
U.S. Appl. No. 14/603,318, Office Action 1 dated Jun. 14, 2017, 26 pages.
U.S. Appl. No. 15/217,212, Office Action 1 dated Jul. 3, 2017, 16 pages.
U.S. Appl. No. 14/635,352, Office Action 2 dated Sep. 13, 2017, 12 pages.
U.S. Appl. No. 14/217,212, Office Action 2 dated Dec. 14, 2017, 14 pages.
U.S. Appl. No. 14/603,321, Office Action dated Mar. 7, 2018, 10 pages.
U.S. Appl. No. 14/635,352, Final Office Action dated Jun. 29, 2018, 8 pages.
U.S. Appl. No. 14/635,352, Office Action dated Mar. 29, 2018, 14 pages.
U.S. Appl. No. 14/603,318, Office Action dated Apr. 3, 2018, 12 pages.
U.S. Appl. No. 15/217,212, Final Office Action dated Apr. 5, 2018, 14 pages.
U.S. Appl. No. 14/603,318, Final Office Action dated Sep. 7, 2018, 19 pages.
U.S. Appl. No. 14/603,321, Office Action dated Sep. 10, 2018, 25 pages.
U.S. Appl. No. 15/217,212, Office Action dated Sep. 20, 2018, 16 pages.
U.S. Appl. No. 15/216,881, Office Action dated Nov. 29, 2018, 9 pages.
Office Action and English Translation thereof for Chinese Patent Application No. 201610116856.4 dated Dec. 24, 2018, 15 pages.
U.S. Appl. No. 14/603,321, Final Office Action dated Mar. 28, 2019, 12 pgs.
U.S. Appl. No. 15/216,881, Final Office Action dated Apr. 4, 2019, 9 pages.
U.S. Appl. No. 15/217,212, Final Office Action dated Apr. 12, 2019, 9 pages.
U.S. Appl. No. 14/603,316, Notice of Allowance dated May 21, 2019, 8 pages.
U.S. Appl. No. 15/216,881, Office Action dated Jul. 18, 2019, 16 pages.
U.S. Appl. No. 14/603,321, Office Action dated Jul. 29, 2019, 15 pages.
U.S. Appl. No. 14/603,316, Office Action dated Sep. 12, 2019, 14 pages.
U.S. Appl. No. 14/603,321, Final Office Action dated Sep. 20, 2019, 9 pages.
U.S. Appl. No. 15/216,881, Office Action 2 dated Sep. 26, 2019, 9 pages.
U.S. Appl. No. 15/217,212, Office Action dated Oct. 2, 2019, 8 pages.
U.S. Appl. No. 14/603,321, Notice of Allowance dated Nov. 6, 2019, 5 pages.

* cited by examiner

TURBINE BUCKET FOR CONTROL OF WHEELSPACE PURGE AIR

BACKGROUND OF THE INVENTION

Embodiments of the invention relate generally to rotary machines and, more particularly, to the control of wheel space purge air in gas turbines.

As is known in the art, gas turbines employ rows of buckets on the wheels/disks of a rotor assembly, which alternate with rows of stationary vanes on a stator or nozzle assembly. These alternating rows extend axially along the rotor and stator and allow combustion gasses to turn the rotor as the combustion gasses flow therethrough.

Axial/radial openings at the interface between rotating buckets and stationary nozzles can allow hot combustion gasses to exit the hot gas path and radially enter the intervening wheelspace between bucket rows. To limit such incursion of hot gasses, the bucket structures typically employ axially-projecting angel wings, which cooperate with discourager members extending axially from an adjacent stator or nozzle. These angel wings and discourager members overlap but do not touch, and serve to restrict incursion of hot gasses into the wheelspace.

In addition, cooling air or "purge air" is often introduced into the wheelspace between bucket rows. This purge air serves to cool components and spaces within the wheelspaces and other regions radially inward from the buckets as well as providing a counter flow of cooling air to further restrict incursion of hot gasses into the wheelspace. Angel wing seals therefore are further designed to restrict escape of purge air into the hot gas flowpath.

Nevertheless, most gas turbines exhibit a significant amount of purge air escape into the hot gas flowpath. For example, this purge air escape may be between 0.1% and 3.0% at the first and second stage wheelspaces. The consequent mixing of cooler purge air with the hot gas flowpath results in large mixing losses, due not only to the differences in temperature but also to the differences in flow direction or swirl of the purge air and hot gasses.

BRIEF DESCRIPTION OF THE INVENTION

In one embodiment, the invention provides a turbine bucket comprising: a platform portion; an airfoil extending radially outward from the platform portion; a shank portion extending radially inward from the platform portion; at least one angel wing extending axially from a face of the shank portion; a platform lip extending axially from the platform portion, the platform lip disposed radially outward from the at least one angel wing; and a plurality of turbulators disposed along and extending outward from the face of the shank portion between the platform lip and the at least one angel wing.

In another embodiment, the invention provides a turbine bucket comprising: a substantially planar platform portion; an airfoil extending radially outward from the platform portion, the airfoil including a leading edge and a trailing edge; a shank portion extending radially inward from the platform portion; at least one angel wing extending axially from a face of the shank portion; a platform lip extending axially from the platform portion, the platform lip disposed radially outward from the at least one angel wing; and a plurality of turbulators disposed along a radially inner surface of the platform lip.

In still another embodiment, the invention provides a method of changing a flow of purge air in a wheelspace of a rotating turbine disk, the method comprising: locating at least one angel wing seal on an axially-disposed face of a turbine bucket adjacent the wheelspace; providing a plurality of turbulators between the at least one angel wing seal and a platform lip disposed radially outward from the at least one angel wing and axially from the axially-disposed face of the turbine bucket, whereby the plurality of turbulators changes a swirl velocity of purge air between the platform lip and the at least one angel wing.

In yet another embodiment, the invention provides a turbine bucket comprising: a substantially planar platform portion; an airfoil extending radially outward from the platform portion; a shank portion extending radially inward from the platform portion; a platform lip extending axially from the platform portion; and a plurality of turbulators disposed along a radially inner surface of the platform lip.

In still yet another embodiment, the invention provides a turbine disk for securing a plurality of turbine buckets, the turbine disk having an outer radial face into which a plurality of turbulators is formed.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements among the drawings.

DETAILED DESCRIPTION OF THE INVENTION

Figure 1:
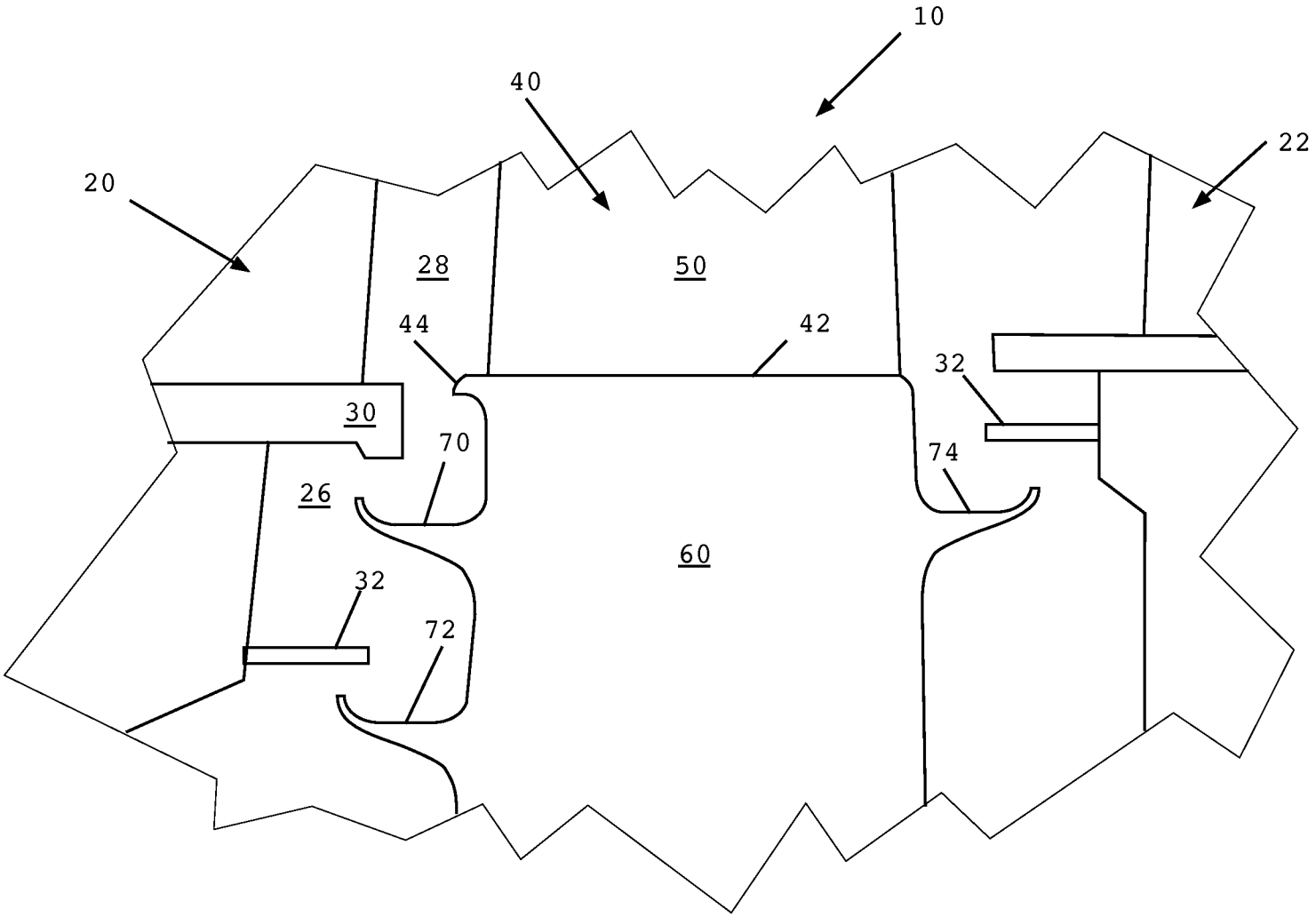
FIG. 1 shows a schematic cross-sectional view of a portion of a known turbine.

Turning now to the drawings, FIG. 1 shows a schematic cross-sectional view of a portion of a gas turbine 10 including a bucket 40 disposed between a first stage nozzle 20 and a second stage nozzle 22. Bucket 40 extends radially outward from an axially extending rotor (not shown), as will be recognized by one skilled in the art. Bucket 40 comprises a substantially planar platform 42, an airfoil extending radially outward from platform 42, and a shank portion 60 extending radially inward from platform 42.

Shank portion 60 includes a pair of angel wing seals 70, 72 extending axially outward toward first stage nozzle 20 and an angel wing seal 74 extending axially outward toward second stage nozzle 22. It should be understood that differing numbers and arrangements of angel wing seals are possible and within the scope of the invention. The number and arrangement of angel wing seals described herein are provided merely for purposes of illustration.

As can be seen in FIG. 1, nozzle surface 30 and discourager member 32 extend axially from first stage nozzle 20 and are disposed radially outward from angel wing seals 70 and 72, respectively. As such, nozzle surface 30 overlaps but does not contact angel wing seal 70 and discourager member 32 overlaps but does not contact angel wing seal 72. A similar arrangement is shown with respect to discourager member 32 of second stage nozzle 22 and angel wing seal 74. In the arrangement shown in FIG. 1, during operation of the turbine, a quantity of purge air may be disposed between, for example, nozzle surface 30, angel wing seal 70, and platform lip 44, thereby restricting both escape of purge air into hot gas flowpath 28 and incursion of hot gasses from hot gas flowpath 28 into wheelspace 26.

While FIG. 1 shows bucket 40 disposed between first stage nozzle 20 and second stage nozzle 22, such that bucket 40 represents a first stage bucket, this is merely for purposes of illustration and explanation. The principles and embodiments of the invention described herein may be applied to a bucket of any stage in the turbine with the expectation of achieving similar results.

Figure 2:
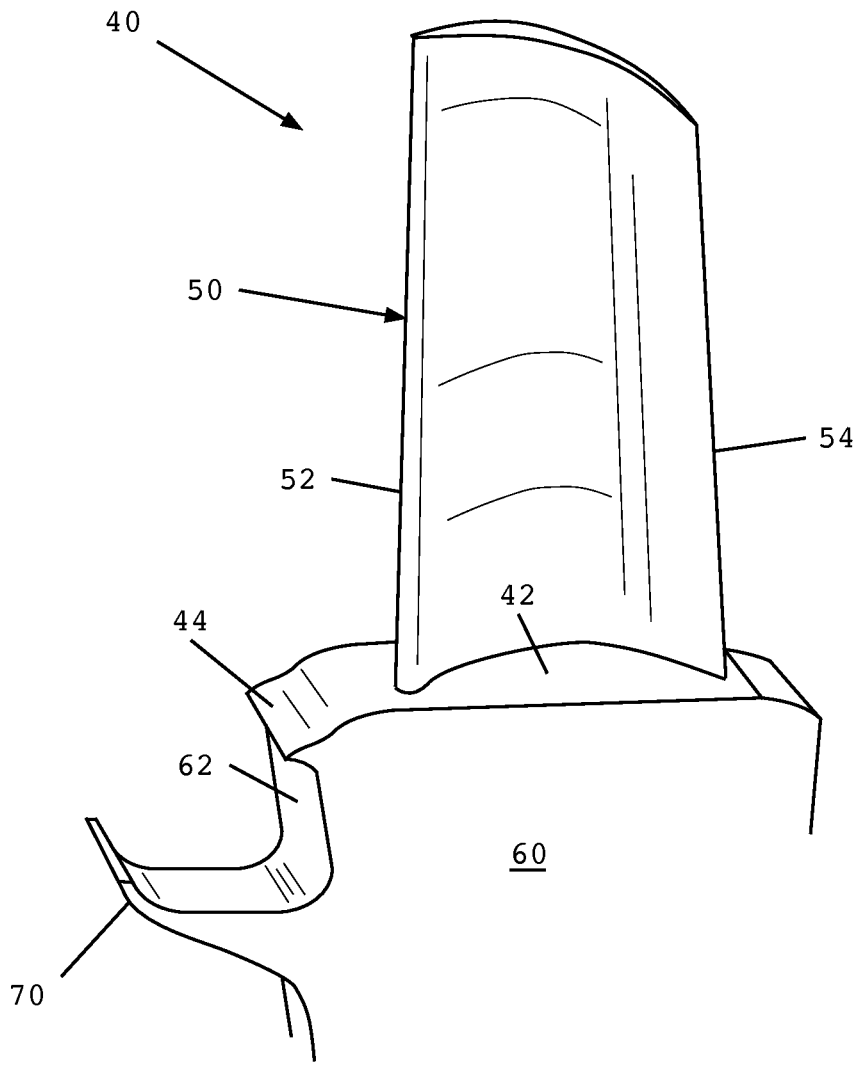
FIG. 2 shows a perspective view of a known turbine bucket.

FIG. 2 shows a perspective view of a portion of bucket 40. As can be seen, airfoil 50 includes a leading edge 52 and a trailing edge 54. Shank portion 60 includes a face 62 nearer leading edge 52 than trailing edge 54, disposed between angel wing 70 and platform lip 44.

Figure 3:
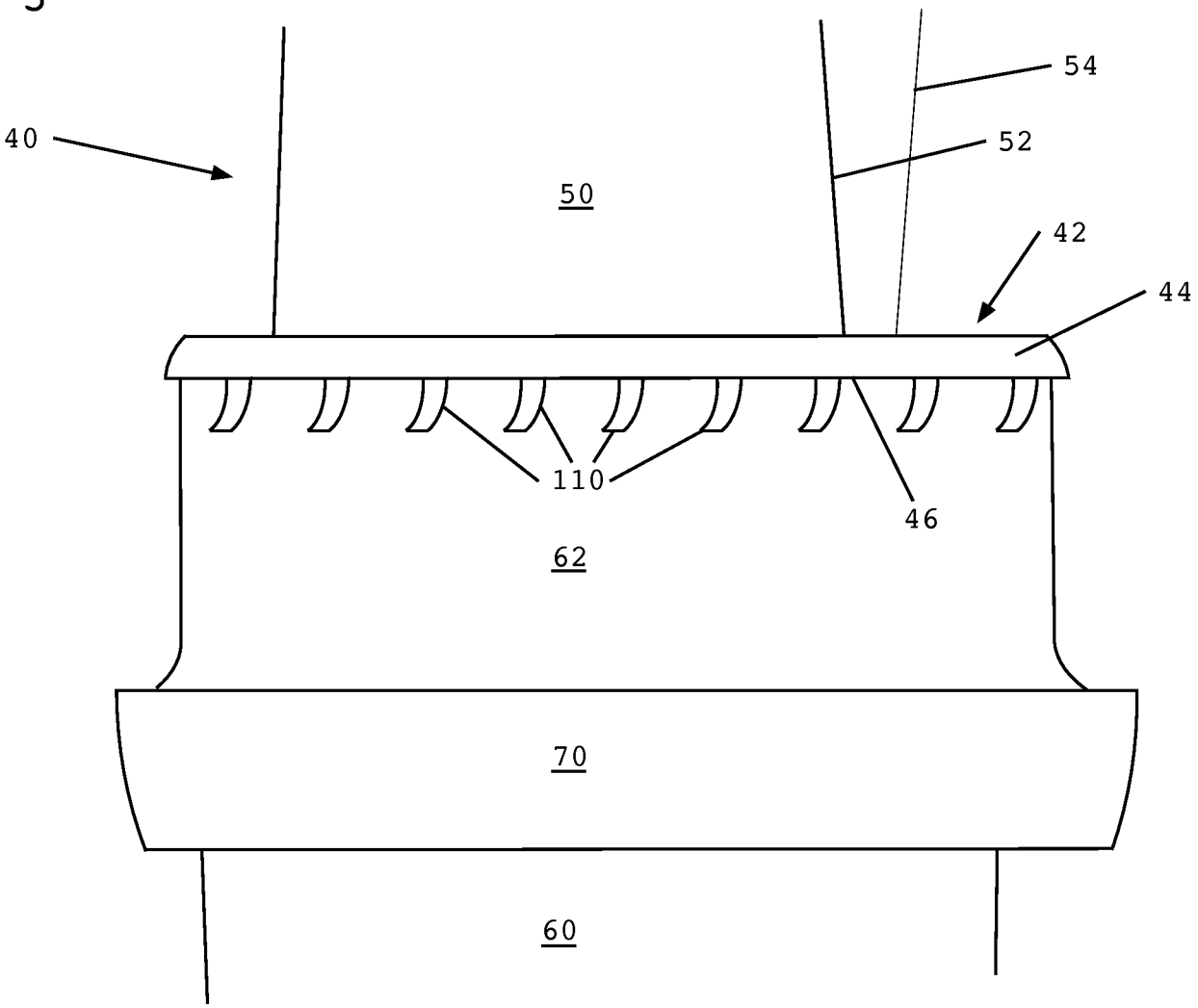
FIG. 3 shows an axially-facing view of a portion of a turbine bucket according to an embodiment of the invention.

FIG. 3 shows a schematic view of bucket 40 looking axially toward face 62. As can be seen, bucket 40 includes a plurality of turbulators 110, which, as described in greater detail below, may extend axially outward from face 62 and/or radially inward from a radially inner surface 46 of platform lip 44. As will also be described in greater detail below, turbulators may be of any number of shapes and orientations.

Figure 4:
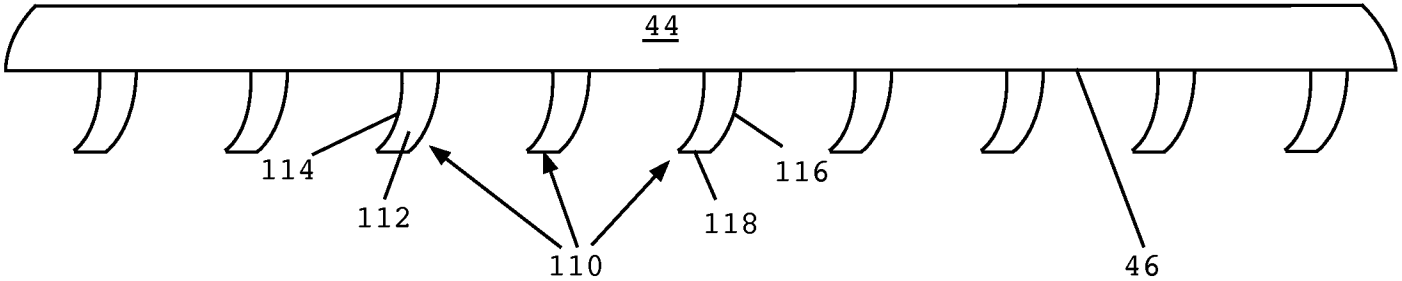
FIGS. 4-8 show schematic views of turbulators according to various embodiments of the invention.

For example, FIG. 4 shows a detailed view of lip with turbulators 110, which comprise a first concave face 114 opening toward an intended direction of rotation R of bucket 40 (FIG. 3), a second convex face 116 opposite first concave face 114, and a radially inner face 118 between first and second concave faces 114, 116. These faces 112, 114, 118 form a body 112 of each turbulator 110. In the embodiment of FIG. 4, each turbulator 110 forms a curved or rib-like member extending radially inward from radially inner surface 46 of platform lip 44. In other embodiments of the invention, turbulators may be separated from radially inner surface 46 of platform lip 44 and extend axially outward from face 62 (FIG. 3). In either case, one or more turbulator 110 may be axially angled, such that, for example, first concave face 114 extends from face 62 at an angle, positive or negative, relative to a longitudinal axis of the turbine. Embodiments of the invention employing axially angled turbulators typically include one or more turbulators which, when installed, are angled ±70 degrees relative to the longitudinal axis of the turbine.

Turbulators 110 draw in purge air and increase its swirl velocity. This results in a small loss of torque, but a net gain in efficiency of approximately 0.5% at the turbine stage. This gain is a consequence of both the increased purge air swirl velocity, which produces a curtaining effect, described further below, as well as a change in swirl angle of the purge air. This change in swirl angle results in the purge air being better aligned with the hot gas flow, resulting in significantly reduced mixing losses when purge air escapes from wheelspace 26 (FIG. 1) to hot gas flowpath 28 (FIG. 1).

Figure 5:
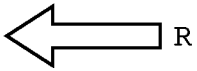
Figure 5:
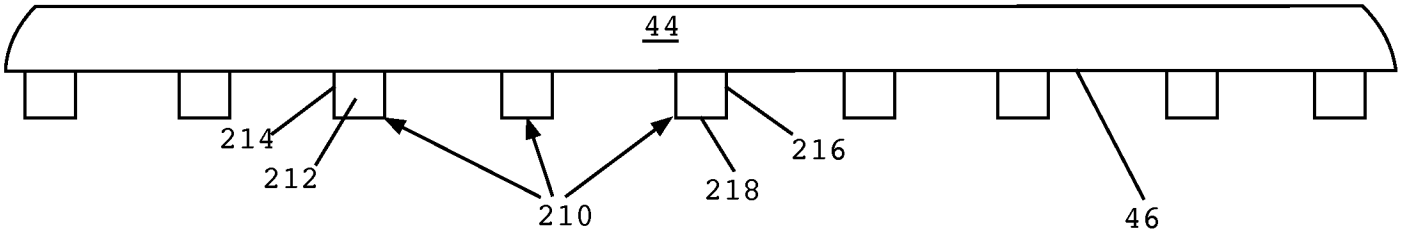
Figure 6:
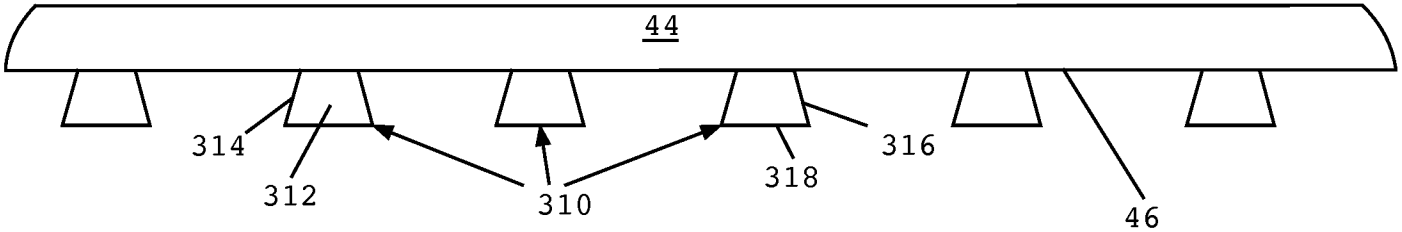
Figure 7:
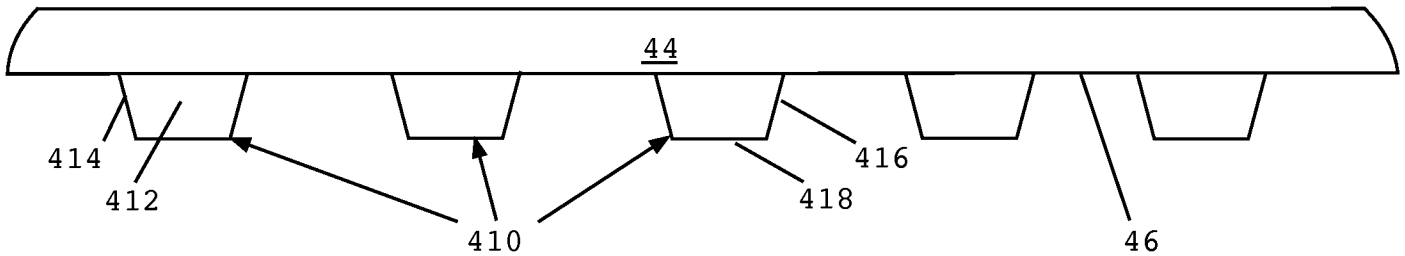
Figure 8:
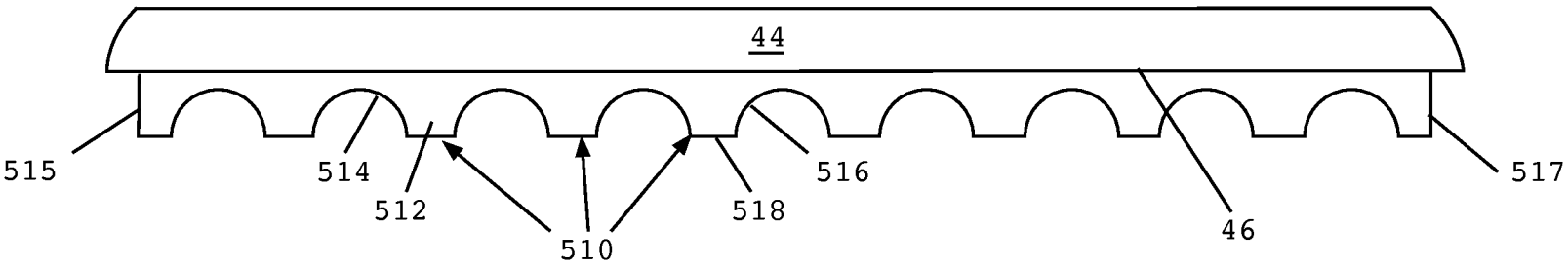

FIGS. 5-8 show turbulators 210 (FIG. 5), 310 (FIG. 6), 410 (FIG. 7), 510 (FIG. 8) having different configurations. In FIG. 5, first and second faces 214, 216 are substantially straight and radially inner face 218 is substantially perpendicular to both first and second faces 214, 216, such that body 212 is substantially rectangular in cross-section. In FIG. 6, each of first and second faces 314, 316 are substantially straight but radially non-perpendicularly angled with respect to radially inner face 318, such that body 312 has a substantially trapezoidal cross-sectional shape, with the wider dimension disposed radially inward. In FIG. 7, on the other hand, first and second faces 414, 416 are radially non-perpendicularly angled with respect to radially inner face 418, such that body 412 has a substantially trapezoidal cross-sectional shape, with the narrower dimension disposed radially inward. In FIG. 8, each turbulator 510 is formed by the intersection of radially inner surface 518 and at least one adjacent arcuate face 514, 516 disposed on either side of radially inner surface 518 of body 512. End faces 515, 517 are substantially straight and extend radially from platform lip 44, thereby enclosing the plurality of turbulators 510.

As noted above, turbulators according to embodiments of the invention may extend axially outward from face 62 and/or radially inward from a radially inner surface 46 of platform lip 44. Where turbulators extend axially outward from face 62, improvements in turbine efficiency are higher the nearer the turbulators are to the radially inner surface 46 of platform lip 44. That is, as turbulators are moved radially inward and away from inner surface 46 of platform lip 44, gains in efficiency are reduced. As will be described in greater detail below with respect to FIGS. 12 and 13, this effect is attributable to the combined ability of platform lip 44 and the turbulators to move the area of purge air with the greatest swirl velocity both radially and axially outward, inducing a curtaining effect, which reduces the incursion of hot gas into wheelspace 26 (FIG. 1). Increasing the space between the turbulators and the platform lip 44 steadily reduces the curtaining effect induced.

Figure 9:
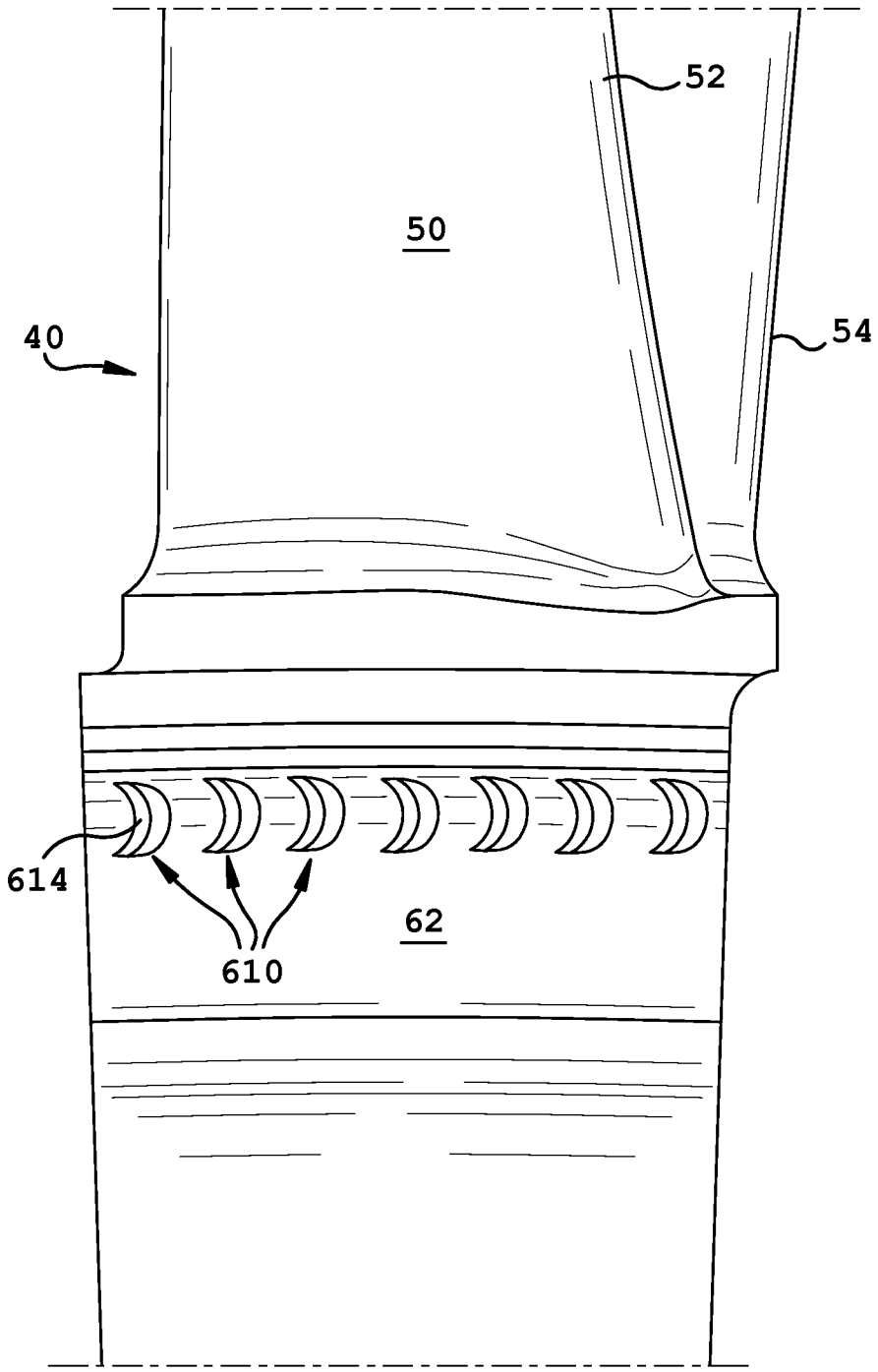
FIG. 9 shows an axially-facing view of a portion of a turbine bucket according to another embodiment of the invention.

FIG. 9 shows a view of a portion of bucket 40 looking axially toward face 62. As can be seen in FIG. 9, each of the plurality of turbulators 610 is axially angled, such that at least first concave face 614 of each turbulator 610 is not normal to face 62. As noted above, such an embodiment may result in a change in the swirl angle of the purge air.

Figure 10:
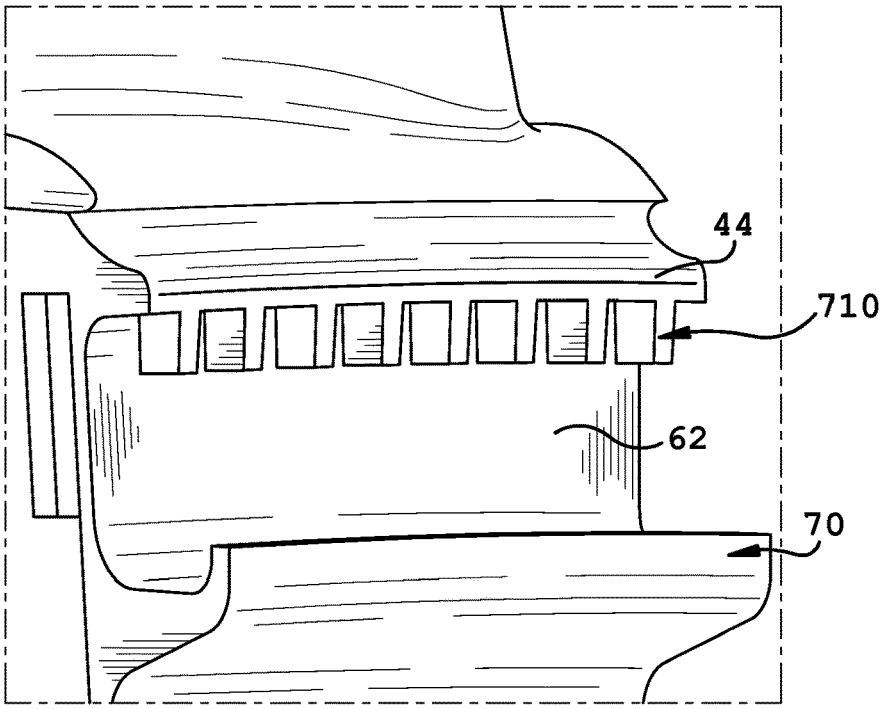
FIGS. 10 and 11 show perspective views of portions of turbine buckets according to still other embodiments of the invention.
Figure 11:
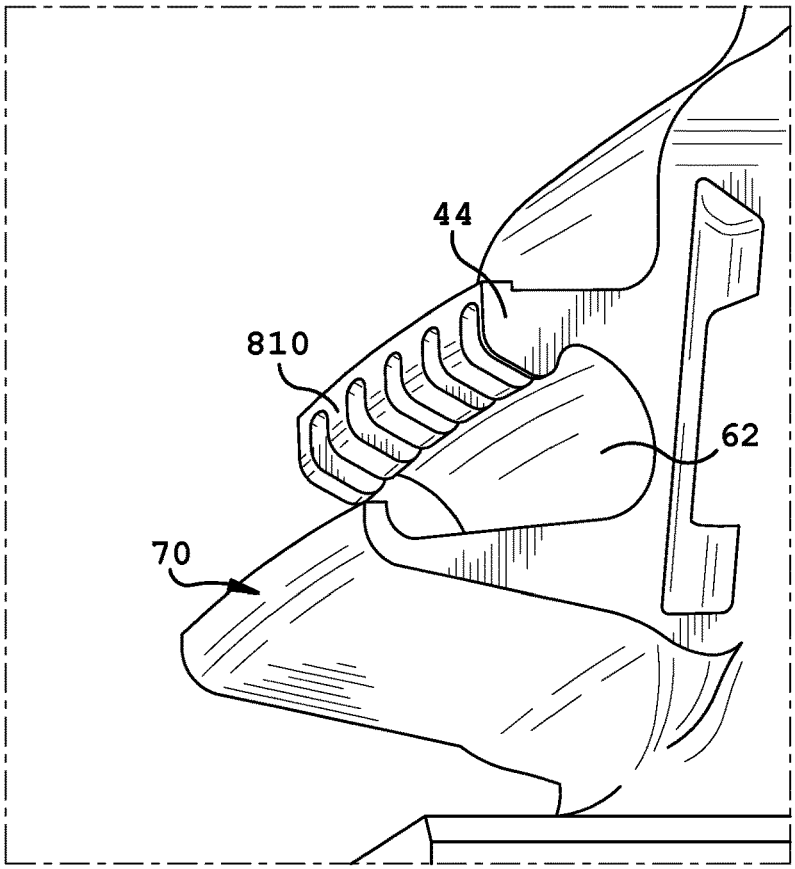

FIGS. 10 and 11 show perspective views of portions of turbine buckets according to still other embodiments of the invention. In FIG. 10, a plurality of turbulators 710 is formed (e.g., machined, cast, etc.) from additional material extending radially inward from platform lip 44. Typically, such additional material will be included in platform lip 44 at the time of casting, with subsequent machining of the cast material employed to form turbulators 710. In other embodiments of the invention, turbulators may be provided in a separate material that is welded, fastened, or otherwise secured to platform lip 44. Turbulators may contact or be axially spaced from face 62. In FIG. 11, for example, turbulators 810 similarly extend from radially inward from platform lip 44 but are axially spaced from face 62, which, in the embodiment shown, is curved.

Although the turbulators 710, 810 shown in FIGS. 10 and 11, respectively, are shown having a substantially rectangular cross-sectional shape, this is neither necessary nor essential. Such turbulators, may have any number of cross-sectional shapes, including, for example, those described above with respect to FIGS. 4-8. Similarly, any such turbulators may be axially angled, as described above with respect to FIG. 9.

Figure 13:
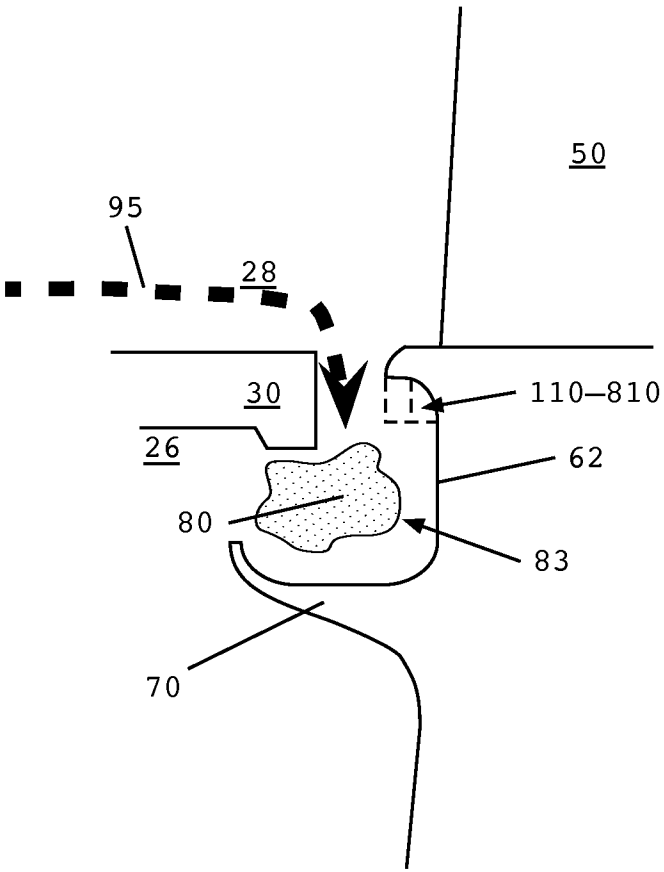
FIG. 13 shows a schematic view of purge air flow in relation to a turbine bucket according to an embodiment of the invention.
Figure 12:
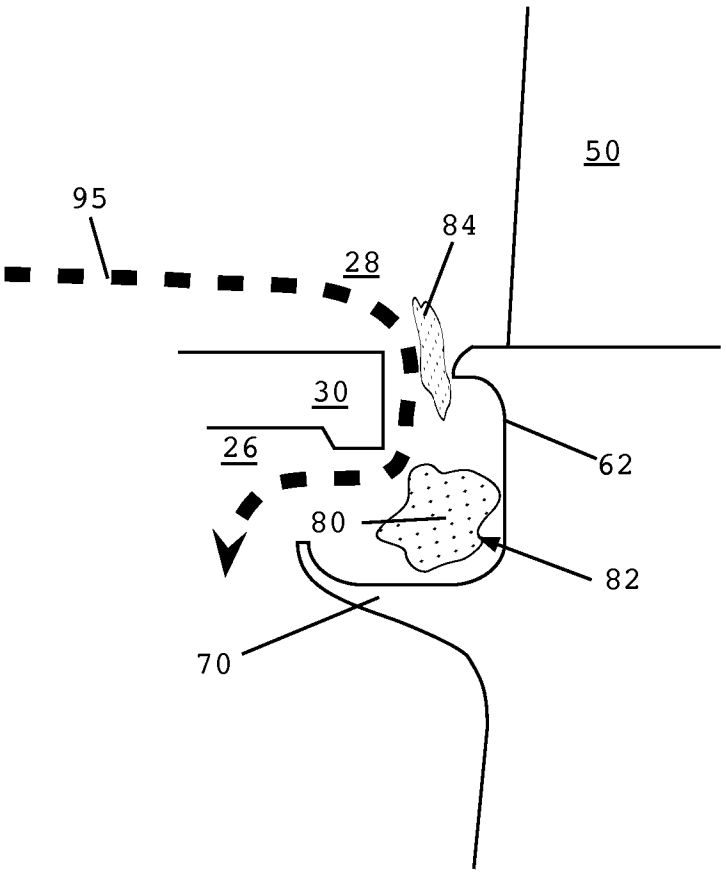
FIG. 12 shows a schematic view of purge air flow in relation to a typical turbine bucket.

FIGS. 12 and 13 show, respectively, schematic representations of purge gas flows in a known gas turbine and in a gas turbine including turbulators according to embodiments of the invention. In FIG. 12, purge air 80 is shown concentrated and having a higher swirl velocity in area 82, with a significant amount of escaping purge air 84 entering hot gas flowpath 28. The concentration of purge air 80 having a higher swirl velocity in area 82, closer to face 62, allows for incursion of hot gas 95 into wheelspace 26.

In contrast, FIG. 13 shows the effect of turbulators 110-810 on purge air 80 according to various embodiments of the invention. As can be seen in FIG. 13, the area 83 in which purge air is concentrated and exhibits a higher swirl velocity is distanced further from face 62 and toward a distal end of angel wing seal 70. In addition, this area 83 of purge air has been moved radially outward and nearer platform lip 44, as compared to FIG. 12. This, in effect, produces a curtaining effect, restricting incursion of hot gas 95 from hot gas flowpath 28 while at the same time reducing the quantity of escaping purge air 85 from wheelspace 26 into hot gas flowpath 28.

The increases in turbine efficiencies achieved using embodiments of the invention can be attributed to a number of factors. First, as noted above, increases in swirl velocity reduces the escape of purge air into hot gas flowpath 28, changes in swirl angle reduce the mixing losses attributable to any purge air that does so escape, and the curtaining effect induced by turbulators according to the invention reduce or prevent the incursion of hot gas 95 into wheelspace 26. Each of these contributes to the increased efficiencies observed.

In addition, the overall quantity of purge air needed is reduced for at least two reasons. First, a reduction in escaping purge air necessarily reduces the purge air that must be replaced. Second, a reduction in the incursion of hot gas 95 into wheelspace 26 reduces the temperature rise within wheelspace 26 and the attendant need to reduce the temperature through the introduction of additional purge air. Each of these reductions to the total purge air required reduces the demand on other system components, such as the compressor from which the purge air is provided.

While reference above is made to the ability of turbulators to change the swirl velocity of purge air within a wheelspace, and particularly within a wheelspace adjacent early stage turbine buckets, it should be noted that turbulators may be employed on turbine buckets of any stage with similar changes to purge air swirl velocity and angle. In fact, Applicants have noted a very favorable result when angel wing rim voids are employed in the last stage bucket (LSB).

Spikes in total pressure ($P_T$) and swirl profiles at the inner radius region of the diffuser inlet are a consequence of a mismatch between the hot gas flow and the swirl of purge air exiting the wheelspace adjacent the LSB. Applicants have found that turbulators according to various embodiments of the invention are capable of both increasing $P_T$ spikes at a diffuser inlet close to the inner radius while at the same time decreasing swirl spikes at or near the same location. Each of these improves diffuser performance. Turbulators, for example, have been found to change the swirl angle of purge air exiting the LSB wheelspace by 1-3 degrees while also increasing $P_T$ spikes by 15-30%.

Figure 14:
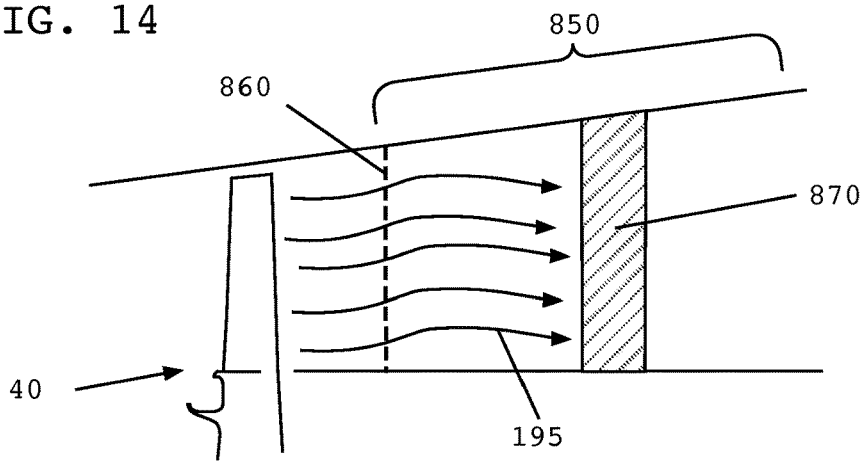
FIG. 14 shows a schematic view of a last stage turbine bucket and diffuser according to an embodiment of the invention.

FIG. 14 shows a schematic view of a LSB 40 adjacent diffuser 850. Hot gas 195 enters diffuser 850 at diffuser inlet plane 860 and passes toward struts 870. Turbulators according to embodiments of the invention reduce the swirl mismatch of purge air as it combines with hot gas 195, preventing separation of hot gas 195 as it enters struts 870. At the same time, voids increase the $P_T$ spike.

Figure 15:
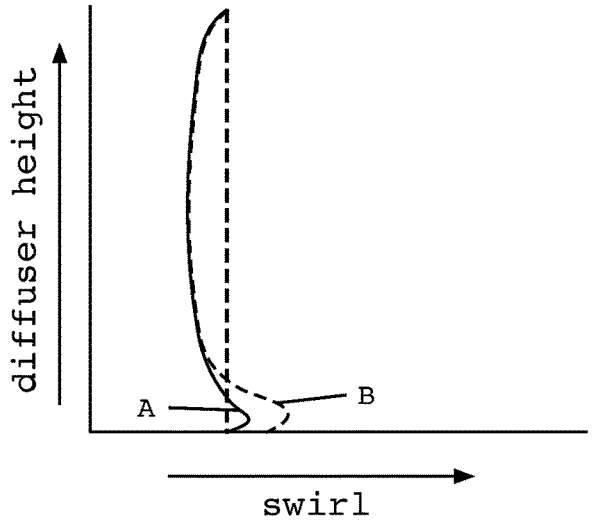
FIG. 15 shows a graph of swirl spike profiles at a diffuser inlet plane for known turbines and turbines according to embodiments of the invention.

FIG. 15 shows a graph of swirl spike as a function of diffuser inlet plane height. Profile A represents a swirl spike profile for a turbine having turbulators according to embodiments of the invention. Profile B represents a swirl spike profile for a turbine without such turbulators. Profile A exhibits a marked decrease in swirl spike at a radially inward position of the diffuser inlet plane.

Figure 16:
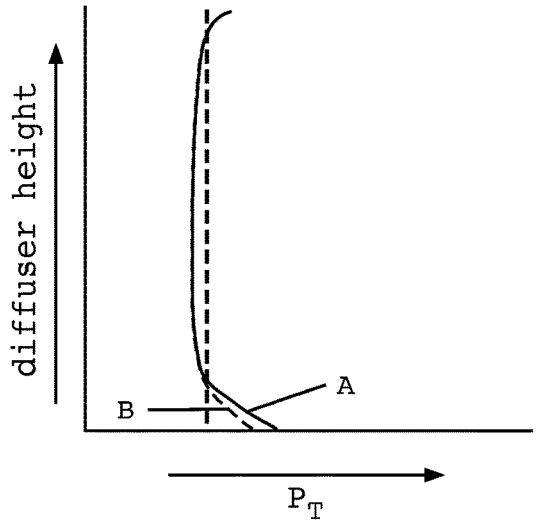
FIG. 16 shows a graph of total pressure spike profiles at a diffuser inlet plane for known turbines and turbines according to embodiments of the invention.

FIG. 16 shows a graph of $P_T$ spike as a function of diffuser inlet plane height. Profile A represents a $P_T$ spike profile for a turbine having turbulators according to embodiments of the invention. Profile B represents a $P_T$ spike profile for a turbine without such turbulators. Profile A exhibits an increase in $P_T$ spike at a radially inward position of the diffuser inlet plane.

Figure 17:
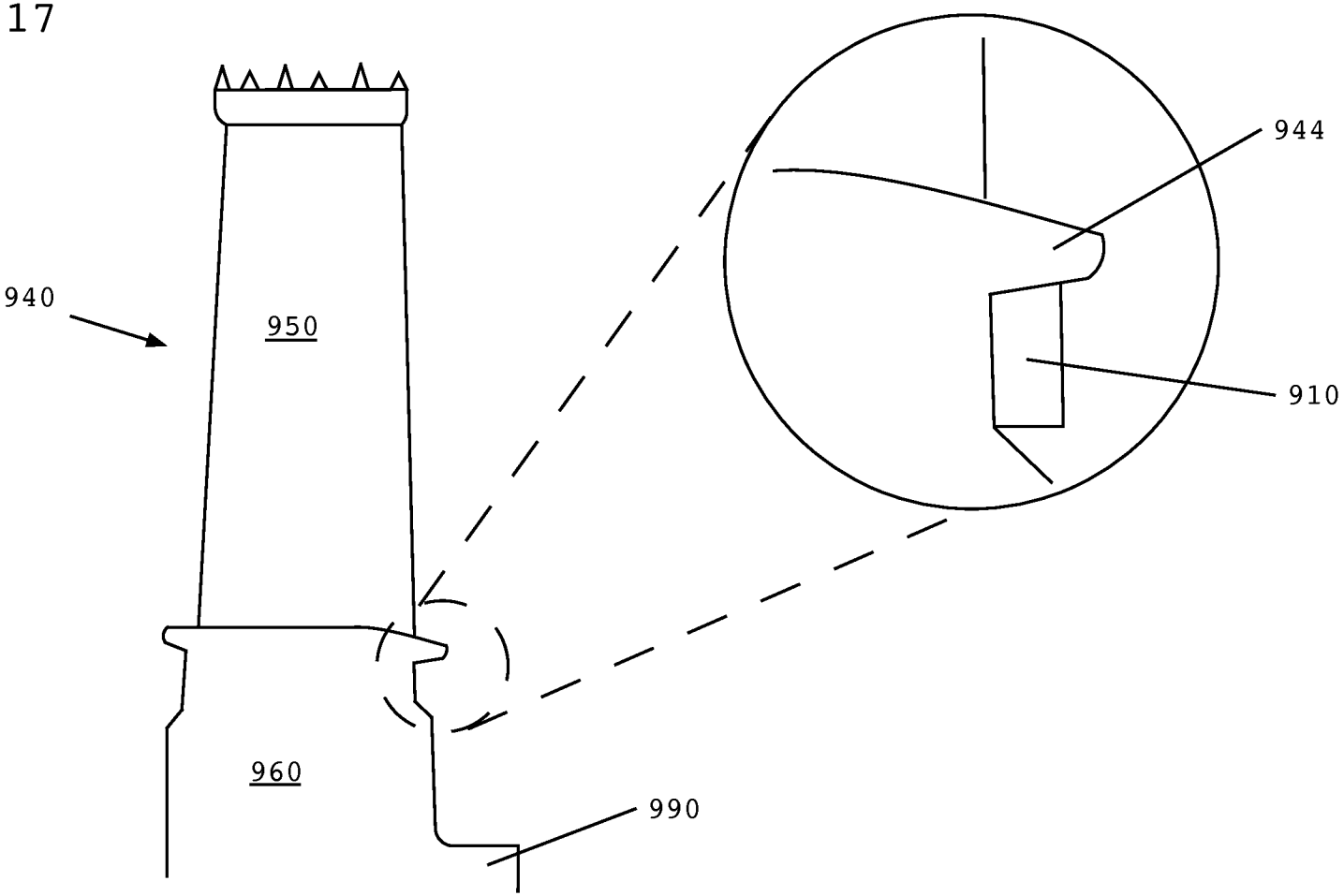
FIG. 17 shows a schematic cross-sectional view of a portion of a steam turbine bucket according to an embodiment of the invention.
Figure 18:
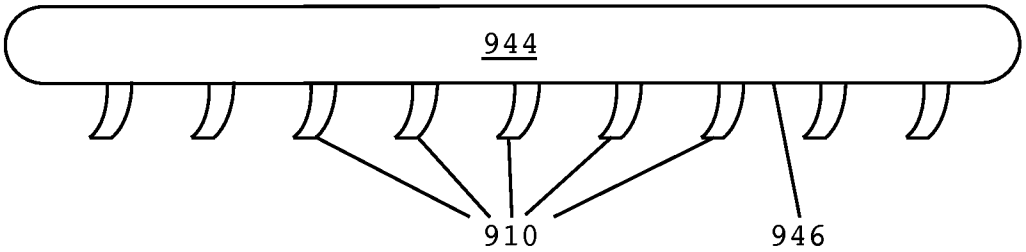
FIG. 18 shows a schematic axial view of a portion of the steam turbine bucket of FIG. 14.

The principle of operation of turbulators described above may also be applied to the operation of steam turbines. For example, FIG. 17 shows a schematic cross-sectional view of a steam turbine bucket 940 having an airfoil 950 and a shank 960 affixed to a disk 990. A magnified view is provided of the area adjacent platform lip, at which turbulators 910 may be disposed. FIG. 18 shows an axial view of platform lip 944 and a plurality of turbulators 910 extending radially inward from a radially inner surface 946 of platform lip.

Steam turbines employing embodiments of the invention such as those described herein will typically realize improvements in efficiency of between 0.1% and 0.5%, depending, for example, on the leakage flow and the stage at which the features are employed.

In each of the embodiments of the invention described above and shown in the figures, a plurality of substantially uniformly arranged turbulators is shown. This, however, is neither necessary nor essential. It may be desirable, for example, to affect a swirl velocity of purge air differently at different points along a bucket surface. In such a circumstance, the arrangement of the plurality of turbulators may be nonuniform.

As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbine bucket comprising:

a platform portion;

an airfoil extending radially outward from the platform portion;

a shank portion extending radially inward from the platform portion;

at least one angel wing extending axially from a face of the shank portion, the at least one angel wing including an upturned distal end;

the at least one angel wing integral with the shank portion;

a platform lip extending axially from the platform portion, the platform lip disposed radially outward from the at least one angel wing;

a wheelspace radially positioned between the platform lip and the at least one angel wing and axially positioned between the shank portion and the upturned distal end of the at least one angel wing; and a plurality of turbulators disposed along and extending outward from the face of the shank portion into the wheelspace, wherein the wheelspace separates the at least one angel wing and the plurality of turbulators such that the at least one angel wing is forward of and below the plurality of turbulators, and wherein, in an operative state, the plurality of turbulators is adapted to increase a swirl velocity of purge air between the platform lip and the at least one angel wing, inducing a curtaining effect that reduces incursion of hot gas into the wheelspace adjacent the face of the shank portion.

2. The turbine bucket of claim 1, wherein each of the plurality of turbulators includes a concave face opening toward an intended direction of rotation of the turbine bucket.

3. The turbine bucket of claim 1, wherein at least one of the plurality of turbulators is axially angled.

4. The turbine bucket of claim 3, wherein the at least one of the plurality of turbulators is axially angled away from a direction of rotation of the turbine bucket.

5. The turbine bucket of claim 4, wherein each of the plurality of turbulators includes a concave face opening toward an intended direction of rotation of the turbine bucket, wherein the at least one of the plurality of turbulators is axially angled such that a first concave face extends from the face of the shank portion at an angle relative to a longitudinal axis of a turbine including the turbine bucket.

6. The turbine bucket of claim 5, wherein the axial angle is equal to ±70 degrees relative to the longitudinal axis.

7. The turbine bucket of claim 3, wherein each of the plurality of turbulators is axially angled.

8. The bucket of claim 1, wherein each of the plurality of turbulators is affixed along a radially inner surface of the platform lip.

9. A turbine bucket comprising:

a platform portion;

an airfoil extending radially outward from the platform portion, the airfoil including a leading edge and a trailing edge;

a shank portion extending radially inward from the platform portion;

at least one angel wing extending axially from a face of the shank portion, the at least one angel wing including an upturned distal end;

the at least one angel wing integral with the shank portion;

a platform lip extending axially from the platform portion, the platform lip disposed radially outward from the at least one angel wing;

a wheelspace radially positioned between the platform lip and the at least one angel wing and axially positioned between the shank portion and the upturned distal end of the at least one angel wing; and a plurality of turbulators disposed along a radially inner surface of the platform lip and extending into the wheelspace, wherein the wheelspace separates the at least one angel wing and the plurality of turbulators such that the at least one angel wing is forward of and below the plurality of turbulators, and wherein, in an operative state, the plurality of turbulators is adapted to increase a swirl velocity of purge air between the platform lip and the at least one angel wing, inducing a curtaining effect that reduces incursion of hot gas into the wheelspace adjacent the face of the shank portion.

10. The turbine bucket of claim 9, wherein each of the plurality of turbulators comprises a curved member extending radially inward.

11. The turbine bucket of claim 10, wherein at least one of the curved members is axially angled.

12. The turbine bucket of claim 11, wherein the at least one of the curved members is axially angled away from a direction of rotation of the turbine bucket.

13. The turbine bucket of claim 11, wherein each of the curved members is axially angled.

14. The turbine bucket of claim 10, wherein each of the plurality of curved members includes a concave face opening toward an intended direction of rotation of the turbine bucket.

15. The turbine bucket of claim 9, wherein each of the plurality of turbulators comprises a first and second face extending radially inward from the radially inner surface of the platform lip.

16. The turbine bucket of claim 15, wherein the first face of each of the turbulators is angled in a first direction with respect to a radial axis of the turbine bucket and the second face of each of the turbulators is angled in a second direction opposite the first direction with respect to the radial axis of the turbine bucket.

17. The turbine bucket of claim 9, wherein each of the plurality of turbulators includes an arcuate face opening radially inward and away from the radially inner surface of the platform lip.

18. A method of reducing incursion of hot gas into a wheelspace of a turbine, the method comprising:

operating a turbine having at least one turbine bucket including:

a platform portion;

an airfoil extending radially outward from the platform portion;

a shank portion extending radially inward from the platform portion;

at least one angel wing extending axially from a face of the shank portion, the at least one angel wing including an upturned distal end;

the at least one angel wing integral with the shank portion;

a platform lip extending axially from the platform portion, the platform lip disposed radially outward from the at least one angel wing;

a wheelspace radially positioned between the platform lip and the at least one angel wing and axially positioned between the shank portion and the upturned distal end of the at least one angel wing; and a plurality of turbulators disposed either along and extending outward from the face of the shank portion or disposed and along a radially inner surface of the platform lip wherein the wheelspace separates the at least one angel wing and the plurality of turbulators such that the at least one angel wing is forward of and below the plurality of turbulators; and inducing a curtaining effect in the wheelspace by increasing a swirl velocity of purge air within the wheelspace, the swirl velocity increase resulting from at least a portion of the purge air passing along the plurality of turbulators.

19. The method of claim 18, wherein the plurality of turbulators is disposed along and extending outward from the face of the shank portion.

20. The method of claim 18, wherein the plurality of turbulators is disposed along the radially inner surface of the platform lip.

* * * * *